US010147387B2

(12) United States Patent
Kang et al.

(10) Patent No.: US 10,147,387 B2
(45) Date of Patent: Dec. 4, 2018

(54) METHOD OF DRIVING DISPLAY PANEL AND DISPLAY APPARATUS FOR PERFORMING THE SAME

(71) Applicant: SAMSUNG DISPLAY CO., LTD., Yongin-si, Gyeonggi-do (KR)

(72) Inventors: Sun-Koo Kang, Seoul (KR); Taegon Kim, Busan (KR); Seungnam Park, Seoul (KR); Ok-Kwon Shin, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/455,342

(22) Filed: Mar. 10, 2017

(65) Prior Publication Data

US 2017/0270889 A1 Sep. 21, 2017

(30) Foreign Application Priority Data

Mar. 15, 2016 (KR) ..... 10-2016-0031082

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2310/0248* (2013.01); *G09G 2330/021* (2013.01)

(58) Field of Classification Search
None
See application file for complete search history.

(56) References Cited

U.S. PATENT DOCUMENTS

2007/0159440 A1* 7/2007 Kang ..... G09G 3/2096 345/99
2014/0375703 A1 12/2014 Ban et al.
2015/0179107 A1* 6/2015 Kim ..... G09G 3/3233 345/212

FOREIGN PATENT DOCUMENTS

KR 10-2015-0000807 1/2015

* cited by examiner

*Primary Examiner* — Gustavo Polo
(74) *Attorney, Agent, or Firm* — F. Chau & Associates, LLC

(57) ABSTRACT

A method of driving a display panel includes, a data driver outputting a precharge voltage to a plurality of pixels of the display panel during a first duration of a horizontal period, the data driver outputting a grayscale voltage to the pixels of the display panel during a second duration of the horizontal period and the data driver initializing the precharge voltage during the second duration of the horizontal period.

18 Claims, 11 Drawing Sheets

METHOD OF DRIVING DISPLAY PANEL AND DISPLAY APPARATUS FOR PERFORMING THE SAME

CROSS-REFERENCE TO RELATED APPLICATIONS

This application claims priority under 35 U.S.C. § 119 to Korean Patent Application No. 10-2016-0031082, filed on Mar. 15, 2016 in the Korean Intellectual Property Office KIPO, the disclosure of which is incorporated by reference in its entirety herein.

BACKGROUND

1. Technical Field

Exemplary embodiments of the present inventive concept relate to a method of driving a display panel and a display apparatus for performing the method. More particularly, exemplary embodiments of the present inventive concept relate to a method of driving a display panel for reducing a power consumption and improving a display quality and a display apparatus for performing the method.

2. Discussion of Related Art

A display apparatus includes a display panel and a display panel driver. The display panel driver includes a timing controller, a gate driver and a data driver. The data driver outputs grayscale voltages to pixels of the display panel. When the display apparatus displays a repetitive pattern of low and high grayscales, the levels of the grayscale voltages repetitively increase and decrease. The repetitive increase and decrease in these levels may cause the display apparatus to increase the amount of power it consumes.

SUMMARY

At least one exemplary embodiment of the present inventive concept provides a method of driving a display panel capable of reducing power consumption of a display apparatus and improving display quality of the display apparatus.

At least one exemplary embodiment of the present inventive concept also provides a display apparatus for performing the above-mentioned method.

A method of driving a display panel according to an exemplary embodiment of the inventive concept includes a data driver outputting a precharge voltage to a plurality of pixels of the display panel during a first duration of a horizontal period, the data driver outputting a grayscale voltage to the pixels of the display panel during a second duration of the horizontal period, and the data driver initializing the precharge voltage during the second duration of the horizontal period.

In an exemplary embodiment, the outputting of the precharge voltage includes a precharge circuit of the data driver transmitting a first precharge voltage to a first group of the pixels and a second precharge voltage to a second group of the pixels.

In an exemplary embodiment, the method includes the data driver connecting the first group of pixels to the precharge circuit through a first precharge switch and connecting the second group of pixels to the precharge part through a second precharge switch during the first duration of the horizontal period; and the data driver connecting the first group of pixels to a first group of buffers through a first group of buffer switches and connecting the second group of pixels to a second group of buffers through a second group of buffer switches during the second duration of the horizontal period.

In an exemplary embodiment, the initializing includes the data driver connecting the precharge circuit to a dummy buffer through a dummy switch during the second duration of the horizontal period.

In an exemplary embodiment, the precharge circuit includes a precharge capacitor. The precharge capacitor may include a first electrode connected to the first group of pixels and a second electrode connected to the second group of pixels.

In an exemplary embodiment, the precharge circuit includes a first precharge capacitor connected to the first group of pixels and a second precharge capacitor connected to the second group of pixels.

In an exemplary embodiment, the initializing includes setting the precharge voltage to a middle grayscale voltage corresponding to an average of a maximum grayscale voltage and a minimum grayscale voltage.

In an exemplary embodiment, the initializing includes setting the precharge voltage to a middle grayscale voltage corresponding to an average of all of the grayscale voltages in a present frame.

In an exemplary embodiment, the first duration of the horizontal period is defined as a duration between a rising edge of a load signal of a data driver and a falling edge of the load signal.

In an exemplary embodiment, the method further includes determining whether a precharge driving method is applied or not based on an image of a present frame. The precharge voltage may be selectively outputted according to a result of the determining whether the precharge driving method is applied or not.

In an exemplary embodiment, the grayscale voltage is outputted to the pixels of the display panel at a falling edge of a load signal of a data driver when the precharge driving method is applied. The grayscale voltage may be outputted to the pixels of the display panel at a rising edge of the load signal of the data driver when the precharge driving method is not applied.

A display apparatus according to an exemplary embodiment of the inventive concept includes a display panel and a data driver. The display panel includes a plurality of pixels. The data driver is configured to output a precharge voltage to the pixels of the display panel during a first duration of a horizontal period, to output a grayscale voltage to the pixels of the display panel during a second duration of the horizontal period and to initialize the precharge voltage during the second duration of the horizontal period.

In an exemplary embodiment, the data driver includes a precharge circuit configured to output the precharge voltage. The precharge circuit may be configured to transmit a first precharge voltage to a first group of the pixels and a second precharge voltage to a second group of the pixels.

In an exemplary embodiment, the data driver includes a first precharge switch configured to connect the first group of the pixels to the precharge circuit during the first duration of the horizontal period, a second precharge switch configured to connect the second group of the pixels to the precharge circuit during the first duration of the horizontal period, a first group of buffer switches configured to connect the first group of pixels to a first group of buffers during the second duration of the horizontal period and a second group of buffer switches configured to connect the second group of pixels to a second group of buffers during the second duration of the horizontal period.

In an exemplary embodiment, the data driver further includes a dummy buffer and a dummy switch. The precharge circuit may be connected to the dummy buffer through the dummy switch during the second duration of the horizontal period.

In an exemplary embodiment, the precharge circuit includes a precharge capacitor. The precharge capacitor may include a first electrode connected to the first group of pixels and a second electrode connected to the second group of pixels.

In an exemplary embodiment, the precharge circuit includes a first precharge capacitor connected to the first group of the pixels and a second precharge capacitor connected to the second group of the pixels.

In an exemplary embodiment, the precharge voltage may be initialized to a middle grayscale voltage corresponding to an average of a maximum grayscale voltage and a minimum grayscale voltage.

In an exemplary embodiment, the precharge voltage is initialized to an average of the grayscale a middle grayscale voltage corresponding to an average of all of the grayscale voltages in a present frame.

In an exemplary embodiment, the first duration of the horizontal period is defined as a duration between a rising edge of a load signal of the data driver and a falling edge of the load signal.

A display driving apparatus according to an exemplary embodiment of the inventive concept includes a precharge circuit, a data driver, and an initialization circuit. The precharge circuit is configured to output a precharge voltage to pixels of a display panel during a first duration of a horizontal period. The data driver is configured to output a grayscale voltage to the pixels of the display panel during a second duration of the horizontal period. The initialization circuit is connected to the precharge circuit and configured to set the precharge voltage to an initialization voltage during the second duration.

In an exemplary embodiment, the precharge circuit includes a capacitor, a first switch connected to odd pixels of the display panel and to a first electrode of the capacitor, and a second switch connected to even pixels of the display panel and to a second electrode of the capacitor, where the data driver closes the first and second switches during the first duration and opens the first and second switches during the second duration.

In an exemplary embodiment, the initialization circuit includes a third switch connected to the odd pixels and a fourth switch connected to the even pixels, where the data driver applies a negative precharge voltage to the first third switch and a positive precharge voltage to the fourth switch, the data driver data driver opens the third and fourth switches during the first duration, and the data driver closes the third and fourth switches during the second duration.

In an exemplary embodiment, the initialization, the initialization voltage is average of minimum and maximum grayscale voltages supported by the display panel or an average of all the grayscale voltages in a present frame In at least one embodiment of the method of driving the display panel and the display apparatus for performing the method, the pixels of the display panel are precharged during a first duration of a horizontal period so that the power consumption of the display apparatus may be reduced. In addition, a precharge voltage is initialized during the time period the grayscale voltage is outputted to the pixels so that an artifact of the display panel due to the differences of the precharge voltages between the pixels may be prevented. Thus, the display quality of the display panel may be improved.

BRIEF DESCRIPTION OF THE DRAWINGS

The present inventive concept will become more apparent by describing detailed exemplary embodiments thereof with reference to the accompanying drawings, in which.

DETAILED DESCRIPTION OF THE EXEMPLARY EMBODIMENTS

Figure 1:
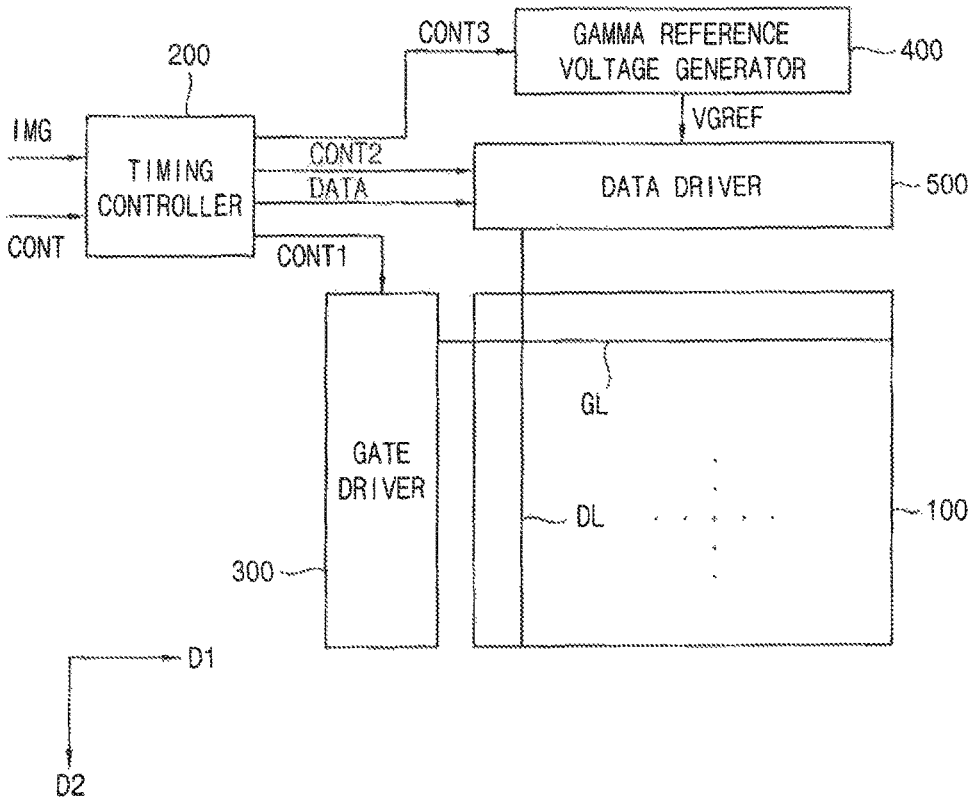
FIG. 1 is a block diagram illustrating a display apparatus according to an exemplary embodiment of the present inventive concept.

Hereinafter, the present inventive concept will be explained in detail with reference to the accompanying drawings. This inventive concept may, however, be embodied in many different forms and should not be construed as limited to the embodiments set forth herein. Like reference numerals refer to like elements throughout this application. As used herein, the singular forms, "a," "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 has a display region on which an image is displayed and a peripheral region adjacent to the display region. In an embodiment, no images are displayed in the peripheral region. In an embodiment, the peripheral region surrounds the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In an embodiment, each pixel includes a switching element and a liquid crystal capacitor. The liquid crystal capacitor is electrically connected to the switching element. The pixels may be disposed in a matrix format.

The timing controller 200 receives input image data IMG and an input control signal CONT from an external apparatus (not shown). The input image data may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 may sequentially output the gate signals to the gate lines GL.

The gate driver 300 may be directly mounted on the display panel 100, or may be connected to the display panel 100 as a tape carrier package (TCP) type. Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA. The gamma reference voltage VGREF may be used to perform gamma correction on the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL. For example, each data voltage may be referred to as a grayscale voltage.

The data driver 500 may be directly mounted on the display panel 100, or be connected to the display panel 100 in a TCP type. Alternatively, the data driver 500 may be integrated on the display panel 100.

A structure and an operation of the data driver 500 will explained by referring to FIGS. 2 to 8 in detail.

Figure 2:
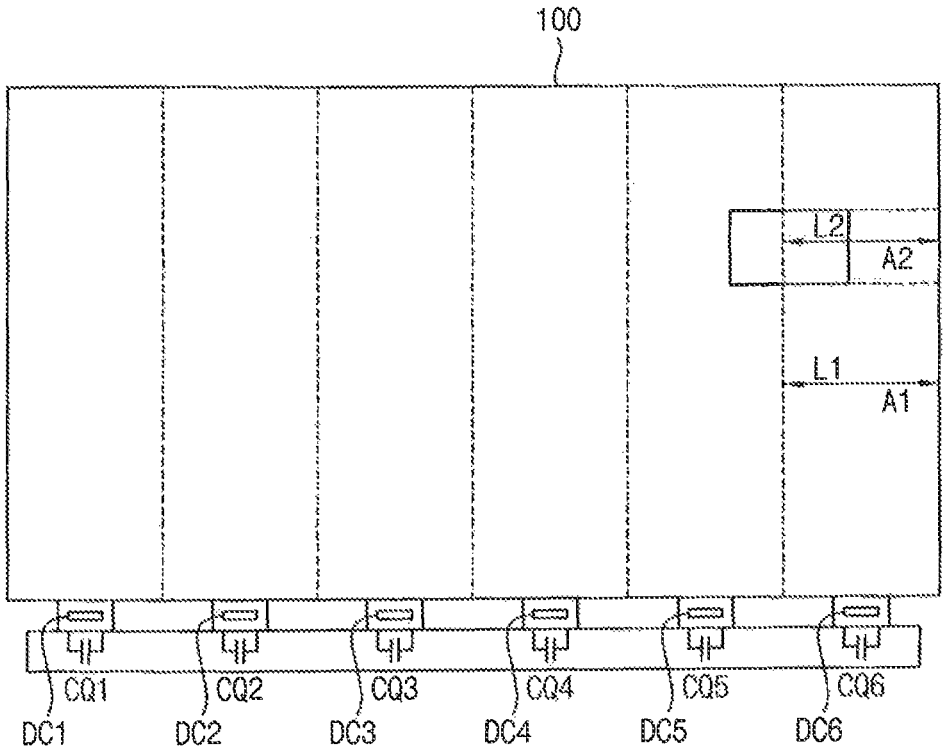
FIG. 2 is a conceptual diagram illustrating a display panel and a data driver of FIG. 1.

FIG. 2 is a conceptual diagram illustrating the display panel 100 and the data driver 500 of FIG. 1 according to an exemplary embodiment of the inventive concept.

Referring to FIGS. 1 and 2, the data driver 500 includes a plurality of data driving chips DC1 to DC6. The display panel 100 includes a plurality of display areas respectively corresponding to the data driving chips DC1 to DC6.

The first data driving chip DC1 outputs grayscale voltages to a first area of the display panel 100. The second data driving chip DC2 outputs grayscale voltages to a second area of the display panel 100. The third data driving chip DC3 outputs grayscale voltages to a third area of the display panel 100. The fourth data driving chip DC4 outputs grayscale voltages to a fourth area of the display panel 100. The fifth data driving chip DC5 outputs grayscale voltages to a fifth area of the display panel 100. The sixth data driving chip DC6 outputs grayscale voltages to a sixth area of the display panel 100.

Although the display panel 100 is driven by the six data driving chips DC1 to DC6 in the present exemplary embodiment, the present inventive concept is not limited to any particular number of the data driving chips. For example, there may be fewer than six data driving chips or there may be more than six data driving chips.

Each data driving chip DC1 to DC6 is connected to a corresponding precharge capacitor CQ1 to CQ6. The precharge capacitor CQ1 to CQ6 is connected to the data driving chip DC1 to DC6 so that the precharge capacitor CQ1 to CQ6 outputs precharge voltages to the pixels of the display area corresponding to the data driving chip DC1 to DC6.

Although a single data driving chip is connected to a single precharge capacitor in the present exemplary embodiment, the present inventive concept is not limited thereto. Alternatively, a plurality of precharge capacitors may be connected to a single data driving chip. For example, when a data driving chip includes 966 channels, all of first to 966-th channels may be connected to a single precharge capacitor. Alternatively, when a data driving chip includes 966 channels, first to 483-th channels may be connected to a first precharge capacitor and 484-th to 966-th channels may be connected to a second precharge capacitor. Alternatively, when the data driving chip includes 966 channels, first to 322-th channels may be connected to a first precharge capacitor, 323-th to 644-th channels may be connected to a second precharge capacitor and 645-th to 966-th channels may be connected to a third precharge capacitor. While the above refers to 966 channels, embodiments of the inventive concept are not limited to any particular number of channels. For example, there may be fewer than 966 channels or more than 966 channels in alternate embodiments.

For example, a white box pattern (e.g. having a 255 grayscale level) is displayed overlapping the fifth area and the sixth area of the display panel 100 in FIG. 2. An area not displaying the white box pattern in the display panel 100 represents a target luminance of gray (e.g., having a 127 grayscale level). A display artifact due to the white box pattern of FIG. 2 is explained referring to FIGS. 3A to 5 in detail.

Figure 3A:
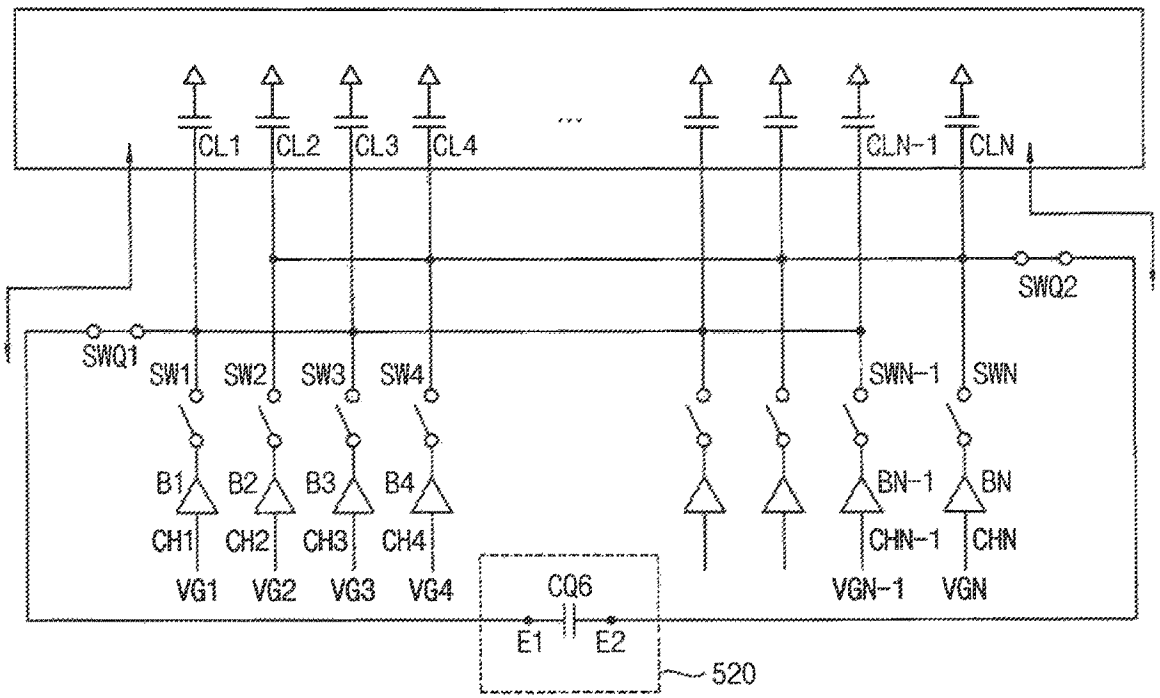
FIGS. 3A and 3B are circuit diagrams illustrating a precharge driving method according to a comparative exemplary embodiment of the present inventive concept.
Figure 3B:
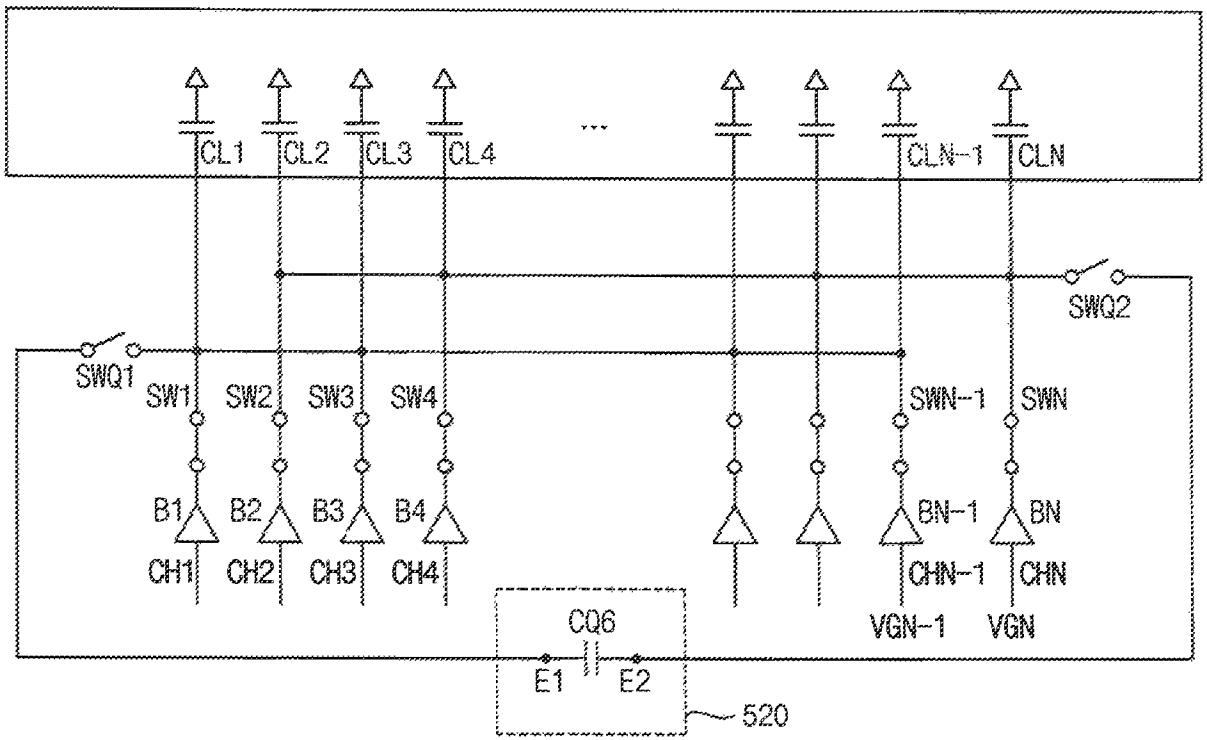
Figure 4:
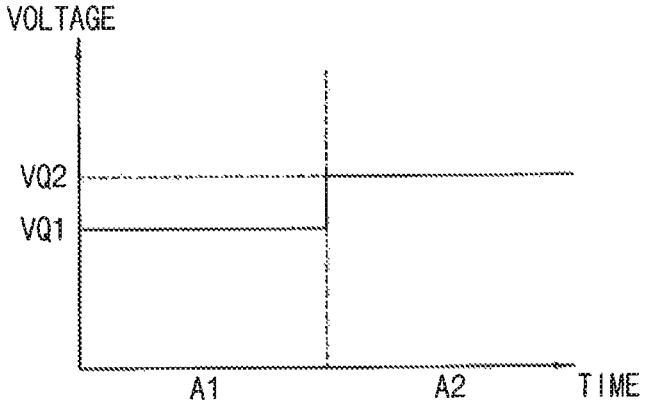
FIGS. 4 and 5 are graphs illustrating a display artifact in the precharge driving method of FIGS. 3A and 3B.
Figure 5:
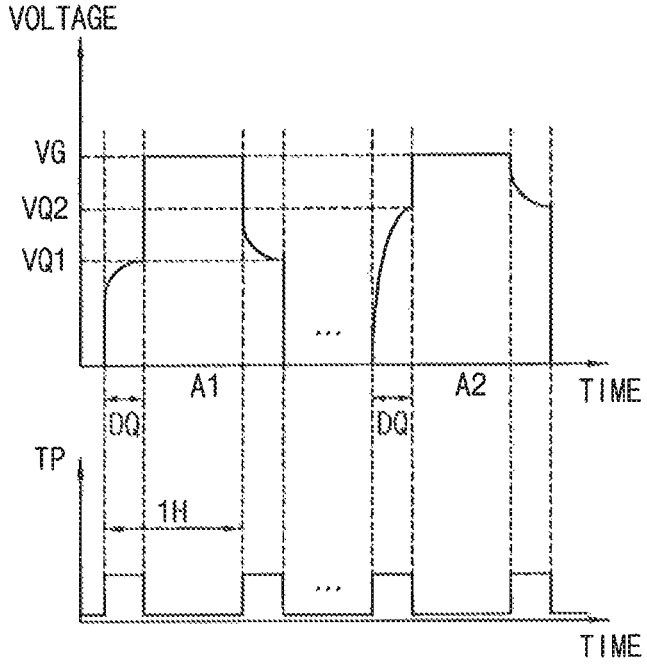

FIGS. 3A and 3B are circuit diagrams illustrating a precharge driving method according to a comparative exemplary embodiment of the present inventive concept. FIGS. 4 and 5 are graphs illustrating a display artifact in the precharge driving method of FIGS. 3A and 3B.

FIGS. 3A and 3B illustrate the sixth data driving chip DC6, the display area corresponding to the sixth data driving chip DC6 and the precharge capacitor CQ6 corresponding to the sixth data driving chip DC6.

Referring to FIGS. 1 to 5, the display panel 100 includes a plurality of pixels. Each pixel includes a liquid crystal capacitor (e.g. CL1 to CLN). The liquid crystal capacitors CL1 to CLN in FIGS. 3A to 3B are the liquid crystal capacitors of the pixels in a single row corresponding to the sixth data driving chip DC6. The number of the pixels in the single row may be N. Herein, N is a natural number.

The data driving chip DC6 includes N channels CH1 to CHN. The data driving chip DC6 includes N buffers. A first buffer B1 outputs a first grayscale voltage VG1 to a first liquid crystal capacitor CL1 of a first pixel. A second buffer B2 outputs a second grayscale voltage VG2 to a second liquid crystal capacitor CL2 of a second pixel.

For example, the display panel 100 may be driven using a column inversion driving method. For example, odd numbered pixels corresponding to the liquid crystal capacitors CL1, CL3, . . . , CLN−1 may be positive pixels and even numbered pixels corresponding to the liquid crystal capacitors CL2, CL4, . . . , CLN may be negative pixels in a first frame. For example, the odd numbered pixels corresponding to the liquid crystal capacitors CL1, CL3, . . . , CLN−1 may be negative pixels and the even numbered pixels corresponding to the liquid crystal capacitors CL2, CL4, . . . , CLN may be positive pixels in a second frame.

The display panel 100 may be driven using the precharge driving method. In an embodiment, the data driver 500 outputs precharge voltages VQ1 and VQ2 to the pixels of the display panel 100 during a first duration DQ of a horizontal period 1H. In this embodiment, the data driver 500 outputs grayscale voltages VG1 to VGN to the pixels of the display panel 100 during a second duration of the horizontal period 1H. The first duration DQ is a precharge duration. The second duration is a main charge duration.

The data driver 500 includes a precharge part 520 (e.g., a precharge circuit) outputting the precharge voltage to the pixels. The precharge part 520 outputs a first precharge voltage to a first group of pixels (e.g. corresponding to the liquid crystal capacitors CL1, CL3, . . . , CLN−1) and a second precharge voltage to a second group of pixels (e.g., corresponding to the liquid crystal capacitors CL2, CL4, . . . , CLN)

FIG. 3A illustrates a connection between the data driver 500 and the display panel 100 during the precharge duration. FIG. 3B illustrates a connection between the data driver 500 and the display panel 100 during the main charge duration.

During the first duration DQ, the first group of pixels corresponding to the liquid crystal capacitors CL1, CL3, . . . , CLN−1 is connected to the precharge part 520 through a first precharge switch SWQ1 and the second group of pixels corresponding to the liquid crystal capacitors CL2, CL4, . . . , CLN is connected to the precharge part 520 through a second precharge switch SWQ2.

During the second duration, the first group of pixels corresponding to the liquid crystal capacitors CL1, CL3, . . . , CLN−1 is connected to a first group of buffers B1, B3, . . . , BN−1 through a first group of buffer switches SW1, SW3, . . . , SWN−1 and the second group of pixels corresponding to the liquid crystal capacitors CL2, CL4, . . . , CLN is connected to a second group of buffers B2, B4, . . . , BN through a second group of buffer switches SW2, SW4, . . . , SWN.

During the first duration DQ, the first group of pixels is disconnected from the first group of buffers, and the second group of pixels is disconnected from the second group of buffers. During the second duration, the first group of pixels and the second group of pixels are disconnected from the precharge part 520.

The precharge part 520 includes a precharge capacitor CQ6 including a first electrode E1 connected to the first group of pixels corresponding to the liquid crystal capacitors CL1, CL3, . . . , CLN−1 and a second electrode E2 connected to the second group of pixels corresponding to the liquid crystal capacitors CL2, CL4, . . . , CLN.

During the first duration DQ, a first precharge voltage level stored at the first electrode E1 is transmitted to the first group of pixels corresponding to the liquid crystal capacitors CL1, CL3, . . . , CLN−1 through the first precharge switch SWQ1. During the first duration DQ, a second precharge voltage level stored at the second electrode E2 is transmitted to the second group of pixels corresponding to the liquid crystal capacitors CL2, CL4, . . . , CLN through the second precharge switch SWQ2.

In the present comparative exemplary embodiment, the level of the precharge voltage is determined as follows. During the first duration DQ, the precharge capacitor CQ6 is connected to the liquid crystal capacitors CL1 to CLN of the pixels so that the precharge capacitor CQ6 shares the charge of the liquid crystal capacitors CL1 to CLN of the pixels.

For example, during the first duration DQ, the first electrode E1 of the precharge capacitor CQ6 is connected to the liquid crystal capacitors CL1, CL3, . . . , CLN−1 of the first group of the pixels. Thus, the voltage level of the first electrode E1 may be similar to or the same as an average of the grayscale voltages of the first group of pixels. The voltage level similar to or the same as the average of the grayscale voltages of the first group of pixels may be used as a precharge voltage for precharging liquid crystal capacitors CL1, CL3, . . . , CLN−1 of the first group of the pixels in a subsequent pixel row.

During the first duration DQ, the second electrode E2 of the precharge capacitor CQ6 is connected to the liquid crystal capacitors CL2, CL4, . . . , CLN of the second group of the pixels. Thus, the voltage level of the second electrode E2 may be similar to or the same as an average of the grayscale voltages of the second group of pixels. The voltage level similar to or the same as the average of the grayscale voltages of the second group of pixels may be used as a precharge voltage for precharging liquid crystal capacitors CL2, CL4, . . . , CLN of the second group of the pixels in a subsequent pixel row.

In FIG. 2, the white box pattern (e.g., having a 255 grayscale level) is displayed overlapping the fifth area and the sixth area of the display panel 100. The area not displaying the white box pattern in the display panel 100 represents a target luminance of gray (e.g., having a 127 grayscale level).

A target grayscale of pixels in an area of A1 may have a 127 grayscale level and an average grayscale of a pixel row L1 covered by the sixth data driving chip DC6 may also have a 127 grayscale level.

In contrast, a target grayscale of pixels in an area of A2 adjacent to the white box pattern may have a 127 grayscale level and an average grayscale of a pixel row L2 covered by the sixth data driving chip DC6 is between 127 grayscale level and 255 grayscale level so that the average grayscale of the pixel row L2 is greater than the average grayscale of the pixel row L1 in the area of A1.

As shown in FIG. 4, the first precharge voltage level VQ1 in the area of A1 is determined by the average grayscale of the pixel row L1 and the second precharge voltage level VQ2 in the area of A2 is determined by the average grayscale of the pixel row L2 so that the second precharge voltage level VQ2 in the area of A2 is greater than the first precharge voltage level VQ1 in the area of A1.

As shown in FIG. 5, the area of A1 is precharged by the first precharge voltage level VQ1 and the area of A2 is precharged by the second precharge voltage level VQ2 greater than the first precharge voltage level VQ1 so that the area of A2 represents a luminance greater than the luminance of the area of A1 even though the target luminance of the area of A2 is same as the target luminance of the area of A1.

As a result, when the white box pattern is displayed at a portion in the display area (e.g. the sixth area), the display artifact may be generated due to the difference of the luminance of the area of A1 and the luminance of the area of A2.

Figure 6A:
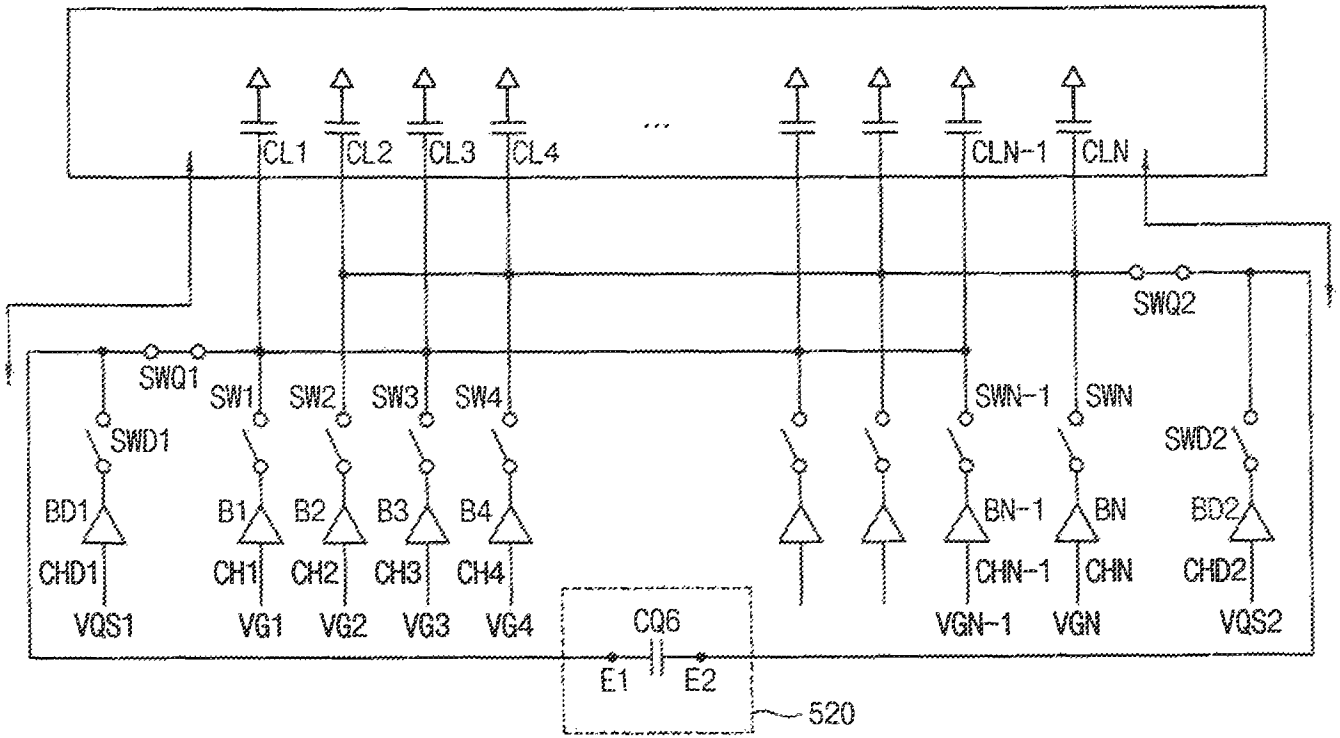
FIGS. 6A and 6B are circuit diagrams illustrating a precharge driving method of the data driver of FIG. 2 according to an exemplary embodiment of the present inventive concept.
Figure 6B:
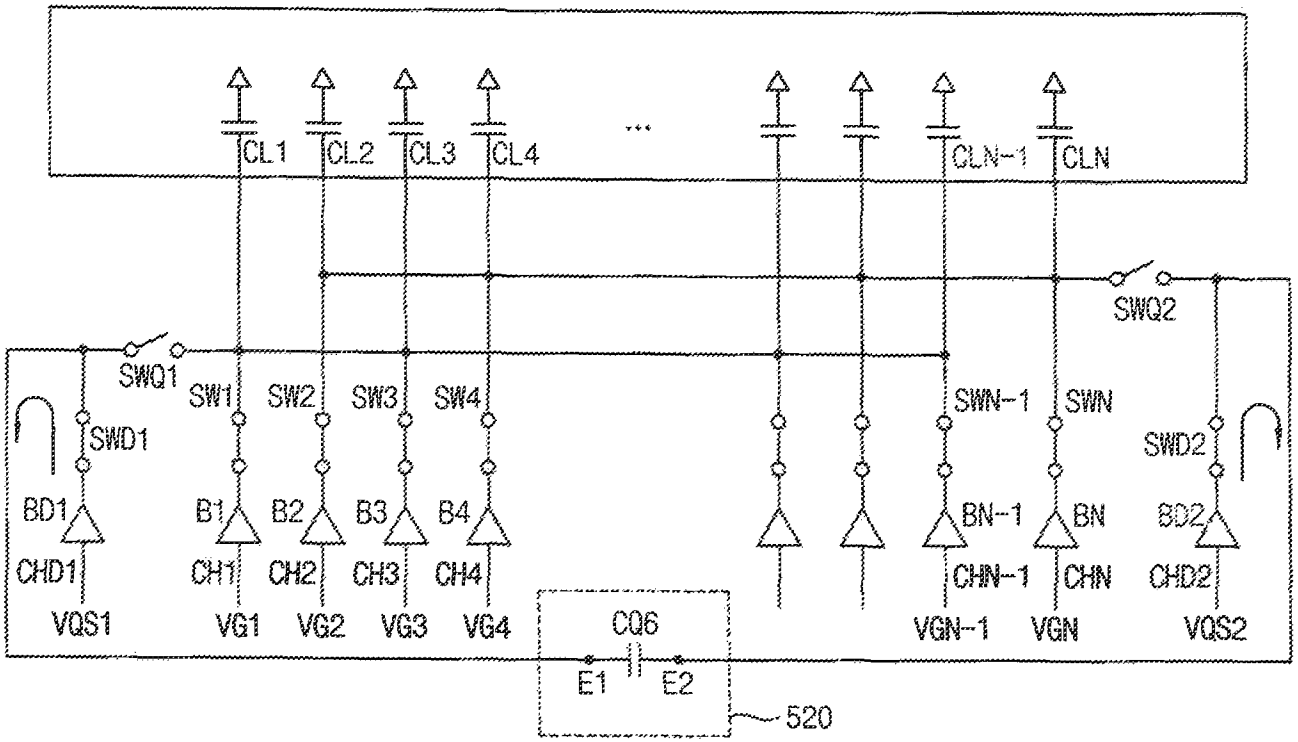
Figure 7A:
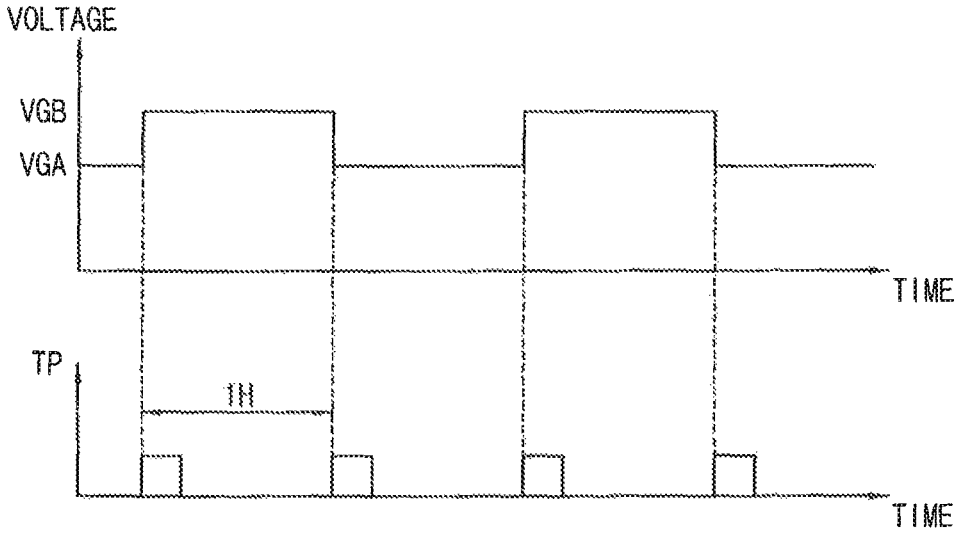
FIGS. 7A and 7B are graphs illustrating a selective precharge driving method of the data driver of FIG. 2 according to an exemplary embodiment of the present inventive concept.
Figure 7B:
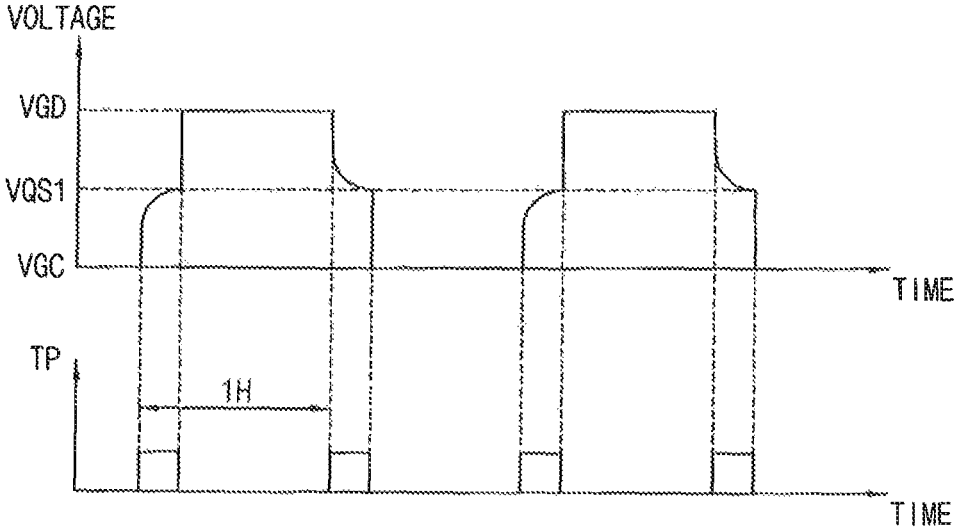
Figure 8:
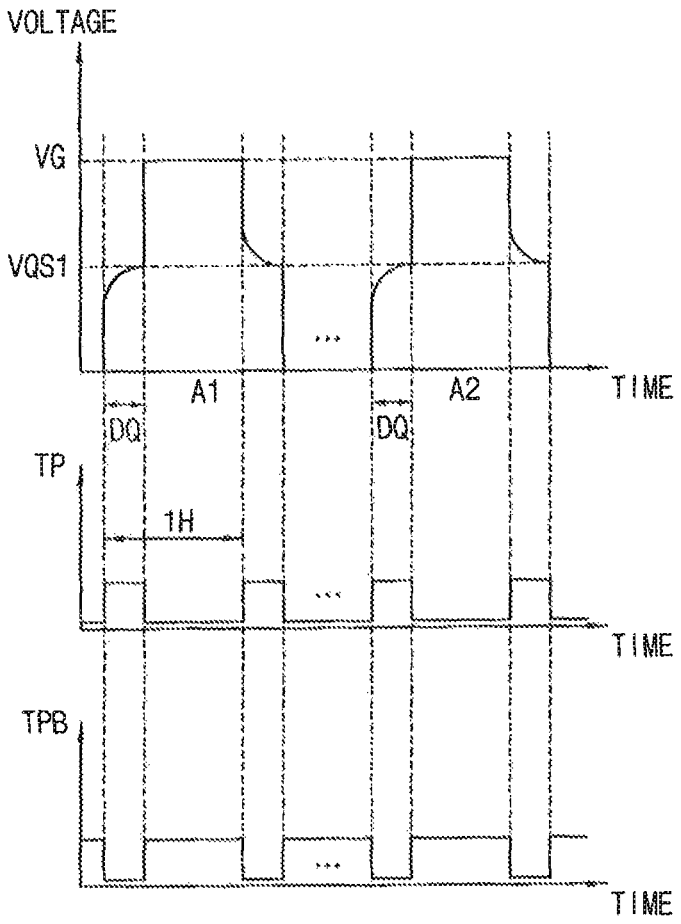
FIG. 8 is a graph illustrating that the display artifact is prevented in the precharge driving method of the data driver of FIG. 2.

FIGS. 6A and 6B are circuit diagrams illustrating a precharge driving method of the data driver of FIG. 2 according to an exemplary embodiment of the inventive concept. FIGS. 7A and 7B are graphs illustrating a selective precharge driving method of the data driver of FIG. 2 according to an exemplary embodiment of the inventive concept. FIG. 8 is a graph illustrating that the display artifact is prevented in the precharge driving method of the data driver of FIG. 2.

The data driver of FIGS. 6A and 6B further includes a first dummy buffer BD1, a second dummy buffer BD2, a first dummy switch SWD1, and a second dummy switch SWD2 compared to the data driver of FIGS. 3A and 3B to control the precharge voltage level. In an embodiment, a dummy buffer is implemented by an operational amplifier configured as a buffer. In an embodiment, a dummy switch may be implemented by a transistor. The term dummy is applied to the dummy buffer and the dummy switch to differentiate them from the normal buffers and normal switches involved in the normal delivery of the grayscale voltages the pixels.

Referring to FIGS. 1 to 8, the display panel 100 may be driven in a column inversion driving method. For example, odd numbered pixels corresponding to the liquid crystal capacitors CL1, CL3, . . . , CLN−1 may be positive pixels and even numbered pixels corresponding to the liquid crystal capacitors CL2, CL4, . . . , CLN may be negative pixels in a first frame. For example, the odd numbered pixels corresponding to the liquid crystal capacitors CL1, CL3, . . . , CLN−1 may be negative pixels and the even numbered pixels corresponding to the liquid crystal capacitors CL2, CL4, . . . , CLN may be positive pixels in a second frame.

The display panel 100 may be driven using the precharge driving method. In an embodiment, the data driver 500 outputs precharge voltages VQ1 and VQ2 to the pixels of the display panel 100 during a first duration DQ of a horizontal period 1H. In this embodiment, the data driver 500 outputs grayscale voltages VG1 to VGN to the pixels of the display panel 100 during a second duration of the horizontal period 1H. The first duration DQ is a precharge duration. The second duration is a main charge duration.

The data driver 500 includes a precharge part 520 (e.g., precharge circuit) outputting the precharge voltage to the pixels. The precharge part 520 outputs a first precharge voltage VQS1 to a first group of pixels (e.g. corresponding to the liquid crystal capacitors CL1, CL3, . . . , CLN−1) and a second precharge voltage VQS2 to a second group of pixels (e.g. corresponding to the liquid crystal capacitors CL2, CL4, . . . , CLN)

FIG. 6A illustrates a connection between the data driver 500 and the display panel 100 during the precharge duration. FIG. 6B illustrates a connection between the data driver 500 and the display panel 100 during the main charge duration.

During the first duration DQ, the first group of pixels corresponding to the liquid crystal capacitors CL1, CL3, . . . , CLN−1 is connected to the precharge part 520 through a first precharge switch SWQ1 and the second group of pixels corresponding to the liquid crystal capacitors CL2, CL4, . . . , CLN is connected to the precharge part 520 through a second precharge switch SWQ2.

During the second duration, the first group of pixels corresponding to the liquid crystal capacitors CL1, CL3, . . . , CLN−1 is connected to a first group of buffers B1, B3, . . . , BN−1 through a first group of buffer switches SW1, SW3, . . . , SWN−1 and the second group of pixels corresponding to the liquid crystal capacitors CL2, CL4, . . . , CLN is connected to a second group of buffers B2, B4, . . . , BN through a second group of buffer switches SW2, SW4, . . . , SWN.

In the present exemplary embodiment of the inventive concept, the precharge part 520 includes a precharge capacitor CQ6 including a first electrode E1 connected to the first group of pixels corresponding to the liquid crystal capacitors CL1, CL3, . . . , CLN−1 and a second electrode E2 connected to the second group of pixels corresponding to the liquid crystal capacitors CL2, CL4, . . . , CLN.

During the first duration DQ, the first precharge voltage level VQS1 stored at the first electrode E1 is transmitted to the first group of pixels corresponding to the liquid crystal capacitors CL1, CL3, . . . , CLN−1 through the first precharge switch SWQ1. During the first duration DQ, the second precharge voltage level VQS2 stored at the second electrode E2 is transmitted to the second group of pixels corresponding to the liquid crystal capacitors CL2, CL4, . . . , CLN through the second precharge switch SWQ2.

In the present exemplary embodiment of the inventive concept, during the second duration in the horizontal period, the precharge voltage is initialized. The data driver 500 further includes a first dummy buffer BD1, a second dummy buffer BD2, a first dummy switch SWD1, and a second dummy switch SWD2. In an embodiment, the dummy buffers BD1 and BD2 are implemented by an operational amplifier. In an embodiment, the dummy switches SWD1 and SWD2 are implemented by transistors. During the second duration, the precharge part 520 is connected to the first dummy part BD1 through the first dummy switch SWD1 and to the second dummy part BD2 through the second dummy switch SWD2. The precharge voltage VQS1 is applied to the first dummy buffer BD1 and the precharge voltage VQS2 is applied to the second dummy buffer BD2.

For example, during the second duration, the liquid crystal capacitors CL1, CL3, . . . , CLN−1 of the first group of the pixels are connected to a first dummy buffer BD1 through a first dummy switch SWD1. During the second duration, the first group of the pixels corresponding to the liquid crystal capacitors CL1, CL3, . . . , CLN−1 are initialized by the first precharge voltage VQS1. During the second duration, the liquid crystal capacitors CL2, CL4, . . . , CLN of the second group of the pixels are connected to a second dummy buffer BD2 through a second dummy switch SWD2. During the second duration, the second group of the pixels corresponding to the liquid crystal capacitors CL2, CL4, . . . , CLN are initialized by the second precharge voltage VQS2.

For example, the first precharge voltage VQS1 may be a positive precharge voltage to precharge the positive pixels.

For example, the second precharge voltage VQS2 may be a negative precharge voltage to precharge the negative pixels.

For example, the precharge voltage VQS1 and VQS2 may be initialized to a middle grayscale voltage corresponding to an average of a maximum grayscale voltage and a minimum grayscale voltage. The maximum grayscale voltage may be a maximum grayscale voltage supported by the display panel 100 and the minimum grayscale voltage may be a minimum grayscale voltage supported by the display panel. For example, when the maximum grayscale level is a 255 grayscale level, the precharge voltage VQS1 and VQS2 may be initialized to the middle grayscale level of 127 grayscale level corresponding to the average of the maximum grayscale level of 255 grayscale level and the minimum grayscale level of 0 grayscale level. For example, the first precharge voltage VQS1 may be initialized by a positive voltage corresponding to 127 grayscale level. For example, the second precharge voltage VQS2 may be initialized by a negative voltage corresponding to a 127 grayscale level.

For example, the precharge voltage VQS1 and VQS2 may be initialized by a middle grayscale voltage corresponding to an average of a maximum grayscale voltage and a minimum grayscale voltage in the present frame. For example, when the maximum grayscale level is 200 grayscale level and the minimum grayscale level is 100 grayscale level in the present frame, the precharge voltage VQS1 and VQS2 may be initialized to the middle grayscale level of 150 grayscale level in the present frame corresponding to the average of the maximum grayscale level of 200 grayscale level and the minimum grayscale level of 100 grayscale level in the present frame. Herein, the grayscale voltages of the present frame may be the grayscale voltages of the corresponding data driving chip (e.g., the sixth data driving chip DC6).

For example, the precharge voltage VQS1 and VQS2 may be initialized by an average of all of the grayscale voltages in the present frame. For example, when the image has a relatively high luminance in the present frame so that the average of all of the grayscale voltages in the present frame is a 200 grayscale level, the precharge voltage VQS1 and VQS2 may be initialized to the average of all of the grayscale voltages corresponding to the 200 grayscale level. For example, when the image has a relatively low luminance in the present frame so that the average of all of the grayscale voltages in the present frame is a 50 grayscale level, the precharge voltage VQS1 and VQS2 may be initialized to the average of all of the grayscale voltages corresponding to 50 grayscale level. Herein, the grayscale voltages of the present frame may be the grayscale voltages of the corresponding data driving chip (e.g., the sixth data driving chip DC6).

The data driver 500 may determine whether the precharge driving method is applied or not based on the image in the present frame. For example, when the difference VGB−VGA of a grayscale level VGB in a previous horizontal period and a grayscale level VGA in a present horizontal period is relatively little as shown in FIG. 7A, the power consumption of the buffers is low so that the precharge driving method is not applied. For example, when the difference VGD−VGC of a grayscale level VGD in a previous horizontal period and a grayscale level VGC in a present horizontal period is relatively great as shown in FIG. 7B, the power consumption of the buffers is great so that the precharge driving method is applied.

In an embodiment, when the precharge driving method is applied, the grayscale voltage is outputted to the pixels of the display panel 100 at a falling edge of a load signal TP of the data driver 500. In an embodiment, when the precharge driving method is not applied, the grayscale voltage is outputted to the pixels of the display panel 100 at a rising edge of the load signal TP of the data driver 500. In an embodiment, the load signal TP indicates when a precharging is to be performed and when grayscale voltages are to be output to a row of pixels. For example, the precharging may be performed while the load signal TP has a first logic state during a given period (i.e., a horizontal period), and the grayscale voltages may be output to the row of pixels when the load signal TP as second other logic state during the given period.

As shown in FIG. 8, the first duration DQ, which is the precharge duration may be defined as a duration between the rising edge of the load signal TP and the falling edge of the load signal TP.

For example, during the first duration DQ, the first precharge switch SWQ1 and the second precharge switch SWQ2 are turned on (e.g., closed) by the load signal TP. During the first duration DQ, the buffer switches SW1 to SWN are turned off (e.g., opened) by a load bar signal TPB. During the first duration DQ, the dummy switches SWD1 and SWD2 are turned off by the load bar signal TPB. The load bar signal TPB may be an inverted signal of the load signal TP.

For example, during the second duration, the first precharge switch SWQ1 and the second precharge switch SWQ2 are turned off (e.g., opened) by the load signal TP. During the second duration, the buffer switches SW1 to SWN are turned on (e.g., opened) by the load bar signal TPB. During the second duration, the dummy switches SWD1 and SWD2 are turned on by the load bar signal TPB.

Hereinafter, it is assumed that the white box pattern (e.g., having a 255 grayscale level) of FIG. 2 is displayed on the display panel of the display apparatus according to the present exemplary embodiment.

In the present exemplary embodiment, the precharge voltage level VQS1 and VQS2 is not determined by the grayscale voltages of the pixels in the previous pixel row but determined by the grayscale voltage applied through the dummy buffer BD1 and BD2. Accordingly, the precharge voltage levels in the area of A1 and in the area of A2 may be substantially the same or the same as each other.

Thus, the area of A1 and the area of A2 are precharged by the precharge voltage level (e.g. VQS1) which is applied through the dummy buffer BD1 so that the area of A1 and the area of A2 may represent substantially the same or the same luminance.

As a result, although the white box pattern is displayed at a portion in the display area (e.g. the sixth area), the display artifact may be removed due to the difference of the luminance of the area of A1 and the luminance of the area of A2.

According to the present exemplary embodiment of the inventive concept, during the first duration DQ of the horizontal period 1H, the pixels of the display panel 100 are precharged so that the power consumption of the display apparatus may be reduced. In addition, the precharge voltage VQS1 and VQS2 is initialized during a period the grayscale voltage VG1 to VGN is outputted to the pixels so that the artifact of the display panel 100 due to the differences of the precharge voltages between the pixels may be prevented. Thus, the display quality of the display panel 100 may be improved.

Figure 9A:
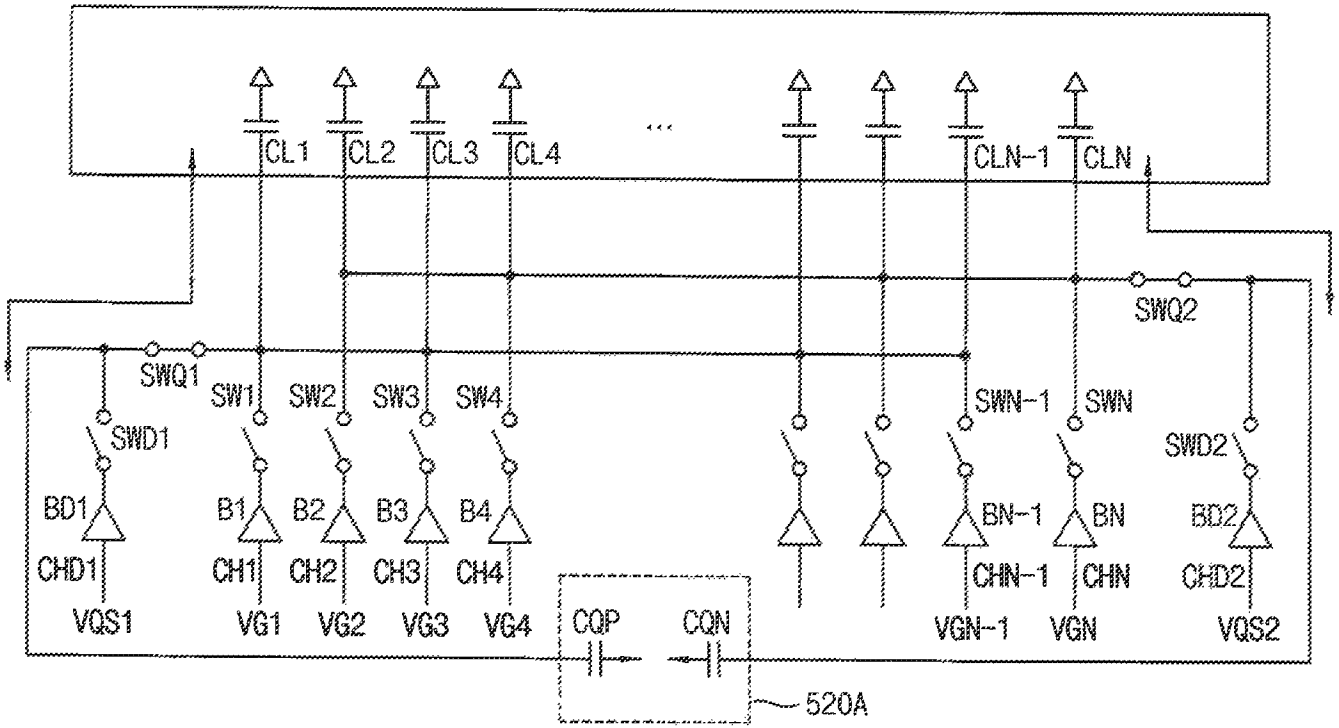
FIGS. 9A and 9B are circuit diagrams illustrating a precharge driving method of a data driver according to an exemplary embodiment of the present inventive concept.
Figure 9B:
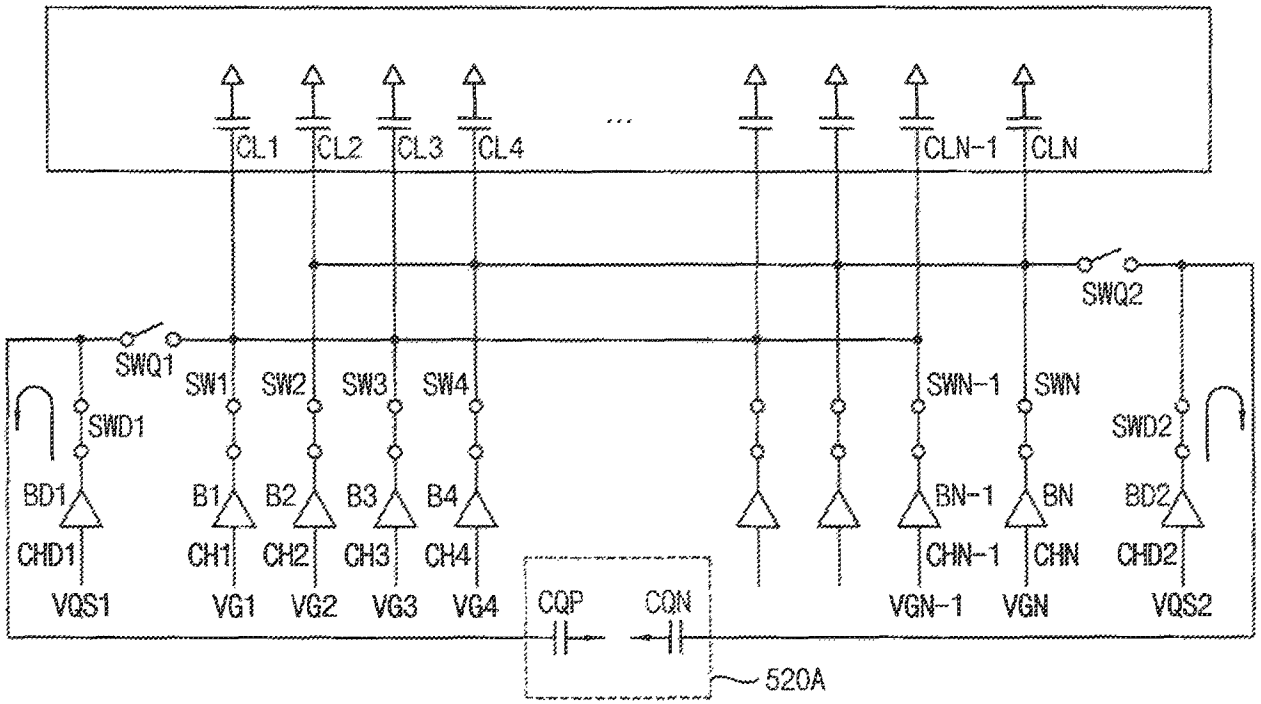

FIGS. 9A and 9B are circuit diagrams illustrating a precharge driving method of a data driver according to an exemplary embodiment of the present inventive concept.

The method of driving the display panel and the display apparatus according to the present exemplary embodiment is substantially the same as the method of driving the display panel and the display apparatus of the previous exemplary embodiment explained referring to FIGS. 1 to 8 except for the structure of the precharge part. Thus, the same reference numerals will be used to refer to the same or like parts as those described in the previous exemplary embodiment of FIGS. 1 to 8 and any repetitive explanation concerning the above elements will be omitted.

Referring to FIGS. 1, 2, 7A to 9B, the display apparatus includes a display panel 100 and a display panel driver. The display panel driver includes a timing controller 200, a gate driver 300, a gamma reference voltage generator 400 and a data driver 500.

The data driver 500 may include a plurality of data driving chips DC1 to DC6. The display panel 100 may include a plurality of display areas respectively corresponding to the data driving chips DC1 to DC6.

The data driver 500 includes a precharge part 520A (e.g., precharge circuit) outputting the precharge voltage to the pixels. The precharge part 520A outputs a first precharge voltage VQS1 to a first group of pixels (e.g. corresponding to the liquid crystal capacitors CL1, CL3, . . . , CLN−1) and a second precharge voltage VQS2 to a second group of pixels (e.g. corresponding to the liquid crystal capacitors CL2, CL4, . . . , CLN)

FIG. 9A illustrates a connection between the data driver 500 and the display panel 100 during the precharge duration. FIG. 9B illustrates a connection between the data driver 500 and the display panel 100 during the main charge duration.

During the first duration DQ, the first group of pixels corresponding to the liquid crystal capacitors CL1, CL3, . . . , CLN−1 is connected to the precharge part 520A through a first precharge switch SWQ1 and the second group of pixels corresponding to the liquid crystal capacitors CL2, CL4, . . . , CLN is connected to the precharge part 520A through a second precharge switch SWQ2. The first duration DQ may correspond to a portion of a horizontal period of the load signal TP having a logical high state.

During the second duration, the first group of pixels corresponding to the liquid crystal capacitors CL1, CL3, . . . , CLN−1 is connected to a first group of buffers B1, B3, . . . , BN−1 through a first group of buffer switches SW1, SW3, . . . , SWN−1 and the second group of pixels corresponding to the liquid crystal capacitors CL2, CL4, . . . , CLN is connected to a second group of buffers B2, B4, . . . , BN through a second group of buffer switches SW2, SW4, . . . , SWN. The second duration may correspond to a portion of the horizontal period of the load signal TP having a logical low state.

In the present exemplary embodiment, the precharge part 520A includes a precharge capacitor CQ6 including a first precharge capacitor CQP connected to the first group of pixels corresponding to the liquid crystal capacitors CL1, CL3, . . . , CLN−1 and a second precharge capacitor CQN connected to the second group of pixels corresponding to the liquid crystal capacitors CL2, CL4, . . . , CLN.

The first precharge capacitor CQP includes a first electrode connected to the first group of pixels and a second electrode connected to ground (e.g., a ground voltage). The second precharge capacitor CQN includes a first electrode connected to the second group of pixels and a second electrode connected to ground.

During the first duration DQ, the first precharge voltage level VQS1 stored at the first precharge capacitor CQP is transmitted to the first group of pixels corresponding to the liquid crystal capacitors CL1, CL3, . . . , CLN−1 through the first precharge switch SWQ1. During the first duration DQ, the second precharge voltage level VQS2 stored at the second precharge capacitor CQN is transmitted to the second group of pixels corresponding to the liquid crystal capacitors CL2, CL4, . . . , CLN through the second precharge switch SWQ2.

In the present exemplary embodiment of the inventive concept, during the second duration in the horizontal period, the precharge voltage is initialized. The data driver 500 further includes a first dummy buffer BD1, a second dummy buffer BD2, a first dummy switch SWD1, and a second dummy switch SWD2. During the second duration, the precharge part 520 is connected to the first dummy buffer BD1 through the first dummy switch SWD1 and connected to the second dummy buffer BD2 through the second dummy switch SWD2. The precharge voltage VQS1 may be applied to the dummy buffer BD1 and the precharge voltage VQS2 may be applied to the dummy buffer BD2.

According to the present exemplary embodiment, during the first duration DQ of the horizontal period 1H, the pixels of the display panel 100 are precharged so that the power consumption of the display apparatus may be reduced. In addition, the precharge voltage VQS1 and VQS2 is initialized during a period the grayscale voltage VG1 to VGN is outputted to the pixels so that the artifact of the display panel 100 due to the differences of the precharge voltages between the pixels may be prevented. Thus, the display quality of the display panel 100 may be improved.

According to at least one embodiment of the present exemplary embodiment as explained above, the power consumption of the display apparatus may be reduced and the display quality of the display panel may be improved.

The foregoing is illustrative of the present inventive concept and is not to be construed as limiting thereof. Although a few exemplary embodiments of the present inventive concept have been described, many modifications are possible in the exemplary embodiments without materially departing from the present inventive concept. Accordingly, all such modifications are intended to be included within the scope of the present inventive concept. In the claims, means-plus-function clauses are intended to cover the structures described herein as performing the recited function and not only structural equivalents but also equivalent structures.

What is claimed is:

1. A method of driving a display, the method comprising:

outputting a precharge voltage to a plurality of pixels of the display panel using a precharge circuit during a first duration of a horizontal period while a load signal received from a data driver is a first logic level;

outputting a grayscale voltage to the pixels of the display panel during a second duration of the horizontal period while the load signal is a second logic level different from the first logic level; and initializing the precharge voltage during the second duration of the horizontal period, wherein the precharge circuit is connected to a dummy buffer through a dummy switch during the second duration of the horizontal period.

2. The method of claim 1, wherein the outputting of the precharge voltage comprises the precharge circuit of the data driver transmitting a first precharge voltage to a first group of the pixels and a second precharge voltage to a second group of the pixels.

3. The method of claim 2, wherein the first group of the pixels is connected to the precharge circuit through a first precharge switch and the second group of the pixels is connected to the precharge circuit through a second precharge switch during the first duration of the horizontal period, and the first group of the pixels is connected to a first group of buffers through a first group of buffer switches and the second group of the pixels is connected to a second group of buffers through a second group of buffer switches during the second duration of the horizontal period.

4. The method of claim 2, wherein the precharge circuit comprises a precharge capacitor, the precharge capacitor comprising a first electrode connected to the first group of the pixels and a second electrode connected to the second group of the pixels.

5. The method of claim 2, wherein the precharge circuit comprises a first precharge capacitor connected to the first group of the pixels and a second precharge capacitor connected to the second group of the pixels.

6. The method of claim 1, wherein the initializing comprises setting the precharge voltage to a middle grayscale voltage corresponding to an average of a maximum grayscale voltage and a minimum grayscale voltage supported by the display panel.

7. The method of claim 1, wherein the initializing comprises setting the precharge voltage to a middle grayscale voltage corresponding to an average of all of the grayscale voltages in a present frame.

8. The method of claim 1, wherein the first duration of the horizontal period is defined as a duration between a rising edge of the load signal of the data driver and a falling edge of the load signal.

9. The method of claim 1, further comprising determining whether a precharge driving method is applied or not based on an image of a present frame, wherein the precharge voltage is selectively outputted according to a result of the determining whether the precharge driving method is applied or not.

10. The method of claim 9, wherein the grayscale voltage is outputted to the pixels of the display panel at a falling edge of a load signal of a data driver when the precharge driving method is applied, and the grayscale voltage is outputted to the pixels of the display panel at a rising edge of the load signal of the data driver when the precharge driving method is not applied.

11. A display apparatus comprising:

a display panel comprising a plurality of pixels; and a data driver configured to output a precharge voltage to the pixels of the display panel during a first duration of a horizontal period while a load signal received from a data driver is a first logic level, to output a grayscale voltage to the pixels of the display panel during a second duration of the horizontal period while the load is a second logic level different from the first logic level and to initialize the precharge voltage during the second duration of the horizontal period, wherein the data driver comprises a precharge circuit configured to output the precharge voltage, wherein the data driver further comprises a dummy buffer and a dummy switch, and the precharge circuit is connected to the dummy buffer through the dummy switch during the second duration of the horizontal period.

12. The display apparatus of claim 11, wherein the precharge circuit is configured to transmit a first precharge voltage to a first group of the pixels and a second precharge voltage to a second group of the pixels.

13. The display apparatus of claim 12, wherein the data driver comprises:

a first precharge switch configured to connect the first group of the pixels to the precharge circuit during the first duration of the horizontal period;

a second precharge switch configured to connect the second group of the pixels to the precharge circuit during the first duration of the horizontal period;

a first group of buffer switches configured to connect the first group of the pixels to a first group of buffers during the second duration of the horizontal period; and a second group of buffer switches configured to connect the second group of the pixels to a second group of buffers during the second duration of the horizontal period.

14. The display apparatus of claim 12, wherein the precharge circuit comprises a precharge capacitor, the precharge capacitor comprising a first electrode connected to the first group of the pixels and a second electrode connected to the second group of the pixels.

15. The display apparatus of claim 12, wherein the precharge circuit comprises a first precharge capacitor connected to the first group of the pixels and a second precharge capacitor connected to the second group of the pixels.

16. A display driving apparatus comprising:

a precharge circuit configured to output a precharge voltage to pixels of a display panel during a first duration of a horizontal period;

a data driver configured to output a grayscale voltage to the pixels of the display panel during a second duration of the horizontal period;

an initialization circuit connected to the precharge circuit and configured to set the precharge voltage to an initialization voltage during the second duration, wherein the precharge circuit is connected to a dummy buffer through a dummy switch during the second duration of the horizontal period.

17. The display driving apparatus of claim 16, wherein the precharge circuit comprises:

a capacitor;

a first switch connected to odd pixels of the display panel and to a first electrode of the capacitor; and a second switch connected to even pixels of the display panel and to a second electrode of the capacitor, wherein the data driver closes the first and second switches during the first duration and opens the first and second switches during the second duration.

18. The display driving apparatus of claim 17, wherein the initialization circuit comprises:

a third switch connected to the odd pixels; and a fourth switch connected to the even pixels, wherein the data driver applies a negative precharge voltage to the first third switch and a positive precharge voltage to the fourth switch, wherein the data driver opens the third and fourth switches during the first duration and closes the third and fourth switches during the second duration.

* * * * *